US005592692A

United States Patent [19]

Larson

[11] Patent Number: 5,592,692

[45] Date of Patent: Jan. 14, 1997

[54] BREASTFEEDING GARMENT

[76] Inventor: Monica R. Larson, 2 S. 781 Winchester Cir. South, #3, Warrenville, Ill. 60555

[21] Appl. No.: 566,184

[22] Filed: Dec. 1, 1995

[51] Int. Cl.[6] ..... A41D 1/20

[52] U.S. Cl. ..... 2/104; 2/243.1; 2/247

[58] Field of Search ..... 2/104, 105, 106, 2/46, 48, 49.1, 49.2, 49.3, 49.4, 49.5, 50, 51, 52, 243.1, 247, 248, 249, 250, 251; 604/3, 4

[56] References Cited

U.S. PATENT DOCUMENTS

| | | | |
|---|---|---|---|
| 2,539,677 | 1/1951 | Teare | 602/4 |
| 2,567,524 | 9/1951 | Marganti | 2/48 |
| 2,598,853 | 6/1952 | Stanton | 602/4 |
| 3,559,640 | 2/1971 | Beckett | 602/4 |
| 5,034,999 | 7/1991 | Lubbers | 2/104 |
| 5,181,274 | 1/1993 | DeFiore | 2/48 X |
| 5,469,582 | 11/1995 | Livingston | 2/104 |

*Primary Examiner*—Jeanette E. Chapman
*Attorney, Agent, or Firm*—Charles F. Meroni, Jr.

[57] ABSTRACT

A breastfeeding garment is provided for use by a woman while breastfeeding a child which conceals the woman's breast. The garment includes a body portion having a top section and a bottom section. The body portion extends downwardly over one of the woman's breasts. The body portion has a pouch section extending substantially from the top section to the bottom section. The pouch section has an inner cavity for receiving an elbow of the wearer. A pair of neck straps are connected to the top section of the body portion for extending around a neck of a wearer allowing the body portion to be swingable about the neck from a first position with the pouch section enveloping a right arm of the wearer to a second position with the pouch section enveloping a left arm of the wearer. A pair waist straps are provided. A waist strap extends from a respective left and right section of the body portion for extending around a waist of the wearer.

15 Claims, 2 Drawing Sheets

BREASTFEEDING GARMENT

BACKGROUND OF THE INVENTION

1. Field of the Invention

The present invention relates generally to a breastfeeding garment for use by women while breastfeeding a child. More particularly, the invention pertains to a breastfeeding garment which conceals a woman's breast while nursing to allow for discreteness.

2. Description of the Prior Art

Studies have determined that breastfeeding is more advantageous to a child than bottle-feeding. Breastfeeding has nourishment advantages for the nursing child over bottle-feeding with formula, as well as creating an intimacy between the mother and child which helps to promote a natural bond.

However, as advantageous and natural as breastfeeding is, many woman are uncomfortable with nursing in public when access to privacy is unavailable. This uncomfortableness or modesty is largely due to the fact that while breastfeeding, it can be difficult for a mother to completely conceal or cover the exposed breast at all times during nursing.

Various prior art nursing garments are known in the art to permit the mother to both nurse and keep her breasts substantially covered. Many prior art garments are primary articles of clothing themselves and do not allow the mother the flexibility of wearing a wide selection of conventional clothing. Others, suffer from having a complicated construction that is fashionably displeasing or simply do not provide a sufficient manner of concealing the breast throughout the entire nursing process.

As will be described in greater detail hereinafter, the breastfeeding garment of the present invention differs from those previously proposed and employs a number of novel features that render it highly advantageous over the prior art.

SUMMARY OF THE INVENTION

Accordingly, it is an object of this invention to provide a breast feeding garment which conceals a woman's breast while nursing.

Another object of this invention is to provide a breastfeeding garment that is easy to wear and of a simplified construction.

Still another object of this invention is to provide a breastfeeding garment that is a supplemental article that can be worn over a wearer's existing clothing.

Yet another object of this invention is to provide a breastfeeding garment that is swingable about the neck of a wearer approximately 180° from a first position for envelopment of a left arm to allow for breastfeeding on a left breast to second position for envelopment of a right arm to allow for breastfeeding on a right breast.

To achieve the foregoing and other objectives, and in accordance with the purposes of the present invention, a breastfeeding garment is provided for use by a woman while breastfeeding a child which conceals the woman's breast. The garment includes a body portion having a top section and a bottom section. The body portion extends downwardly over one of the woman's breasts. The body portion has a pouch section extending substantially from the top section to the bottom section. The pouch section has an inner cavity for receiving an elbow of the user. A pair of neck straps are connected to the top section of the body portion for extending around a neck of a wearer allowing the body portion to be swingable about the neck from a first position with the pouch section enveloping a right arm of the wearer to a second position with the pouch section enveloping a left arm of the wearer.

In accordance with an aspect of the invention, a pair of waist straps are provided. A waist strap extends from a respective left and right section of the body portion for extending around a waist of the wearer and in detachable engagement with one another.

In accordance with another aspect of the invention, the pouch section includes a fold portion and stitched edge. The timid portion and stitched edge being in converging relationship to define the inner cavity.

Other objects, features and advantages of the invention will become more readily apparent upon reference to the following description when taken in conjunction with the accompanying drawings.

DETAILED DESCRIPTION OF THE PREFERRED EMBODIMENT

Figure 1:
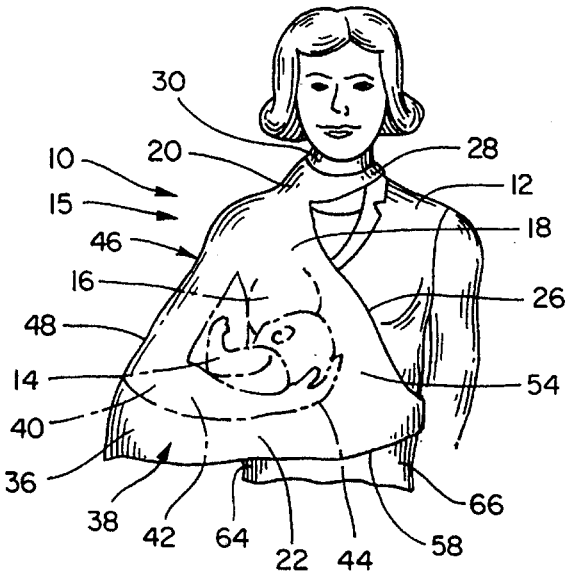
FIG. 1 is a from perspective view of the present invention being worn by mother to breastfeed on her right side.

Referring now to the drawings, a garment 10 for use by a woman 12 while breastfeeding a child 14 is illustrated in FIG. 1. The garment is constructed of any suitable fabric such as cotton, wool, or synthetic material.

The garment 10 conceals the woman's breast 16 while nursing, and can be selectively worn on the right or left side, as shown in FIGS. 1–4. The garment comprises a body portion 18 having a top section 20 and a bottom section 22. The body portion 18 is preferably formed of a single piece of material having a right edge or seam 24 and a left edge or seam 26 extending generally downwardly and outwardly from the top section 20 to the bottom section 22 to extend over an uncovered breast.

A pair of neck straps 28, 29 are connected to or formed integral with the top section 20 of the body portion 18 for extending around a neck 30 of the wearer and in detachable engagement with one another. The neck straps 28, 29 have neck strap ends 32, 33 which have mated hook and loop type fastening members 34, 35, such as products sold under the trade name of VELCRO, connected thereto for allowing detachable engagement of the neck straps 28, 29 to one another. It should be understood that a single strap extending about the neck or other similar strap means could equally be used.

The body portion 18 has a pouch section 36 extending diagonally substantially from the top section 20 to the bottom section 22. The pouch section 36 being structurally sized for envelopment of either arm of a wearer. The pouch section 36 has an inner cavity 38 for receiving an elbow 40 of the wearer and part or all of the child 14. During breastfeeding, the mothers forearm 42 and hand 44 will support the child 14. The mother's arm 46 will be bent allowing the elbow to be inserted into the inner cavity 38. It should be understood that the amount of the child extending within the inner cavity 38, if any, is largely dependent on the size of the child and the positioning of the mother during nursing.

Figure 2:
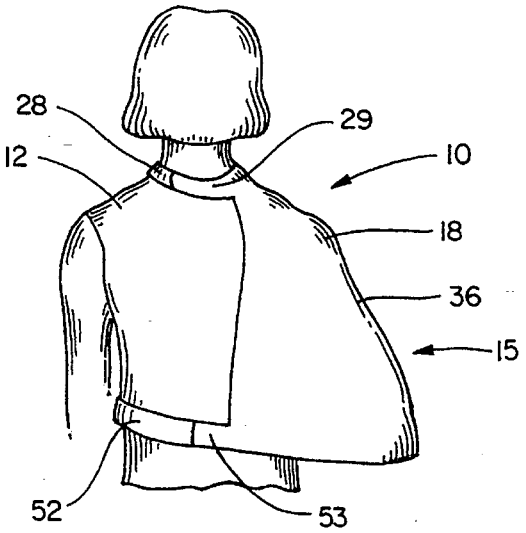
FIG. 2 is a back perspective view of the present invention, as shown in FIG. 1, being worn by mother to breastfeed on her right side.
Figure 3:
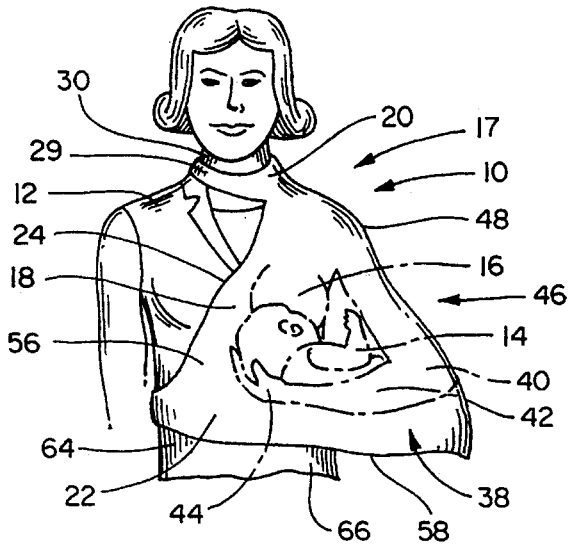
FIG. 3 is a front perspective view of the present invention being worn by mother to breastfeed on her left side.
Figure 4:
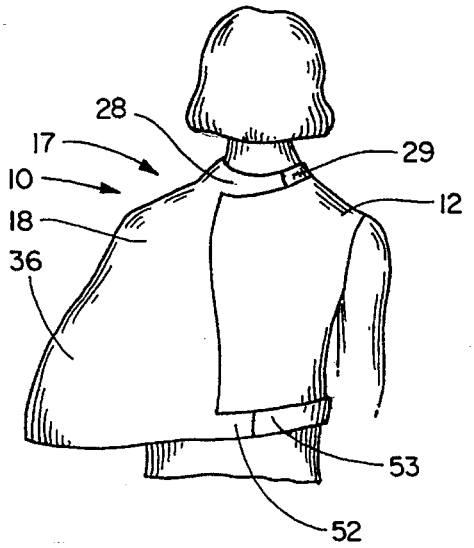
FIG. 4 is a back perspective view of the present invention, as shown in FIG. 3, being worn by mother to breastfeed on her left side.

As shown in FIGS. 1–4, the body portion is swingable about the neck in cooperation with the neck straps 28, 29 approximately 180° from a first position 15, shown in FIGS. 1 and 2, with the pouch section enveloping a right arm of the wearer to a second position 17, shown in FIGS. 3 and 4, with the pouch section enveloping a left arm of the wearer. A right section 56 of the body portion 18 then extends substantially across and in confronting engagement with a left side 66 of the wearer in the first position 15. A left section 54 of the body portion 18 extends substantially across and in confronting engagement with a right side 64 of the wearer in the second position 17.

Figure 5:
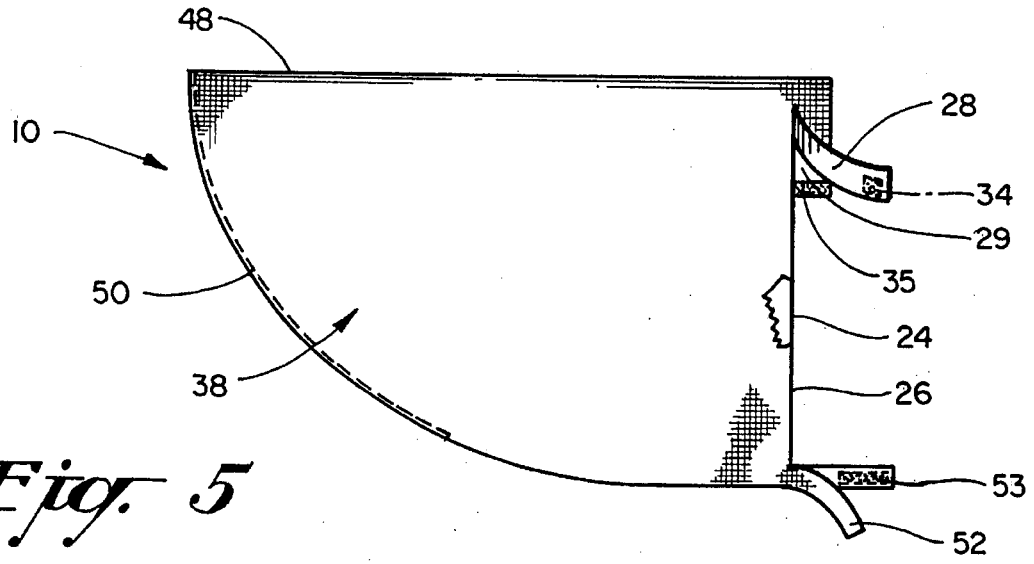
FIG. 5 an elevation view of the present invention symmetrically folded in half.

Referring to FIG. 5, the pouch section 36 has a looped, fold portion or first bounded edge 48 and a stitched or second bounded edge 50. The fold portion 48 divides the body portion into two approximately equal halves. The stitched edge 50 is formed by attaching, such as by sewing, the lapped outer edges of the halves. In a preferred embodiment, the stitched edge 50 is formed through lapped edges within the inner cavity, so that the outer surface of the body portion does not have any frayed edges. The fold portion 48 and stitched edge 50 are in converging relationship to one another to define the inner cavity 38 with the fold portion 48 extending diagonally from the top section 20.

Figure 6:
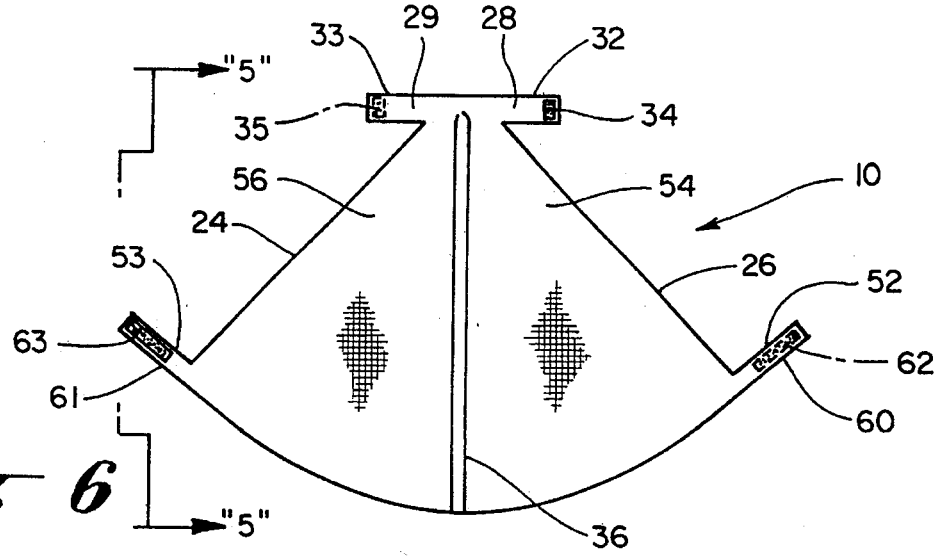
FIG. 6 is a elevation view of the present invention folded to outwardly extend the pouch section.

As an additional feature of the garment 10 is a pair waist straps 52, 53 connected to the body portion 18 or formed integral with, as shown in FIG. 6. A waist strap extends from a respective left section 54 and right section 56 of the body portion 18 for extending around a waist 58 of the wearer and in detachable engagement with one another, as shown in FIG. 2 and 4. The waist straps 52, 53 have waist strap ends 60, 61 which have mated hook and loop type fastening members 62, 63 connected thereto for allowing detachable engagement of the waist straps 52, 53 to one another.

Referring to FIG. 5, garment 10 is shown symmetrically folded in half as it would lie upon a flat table for illustrative purposes of showing the layout and configuration of the body portion 18. It can be seen that the right edge 24 and left edge 26 which are overlapping and in alignment with one another in this view, are approximately perpendicular to the fold portion 48 in the preferred embodiment.

Figure 7:
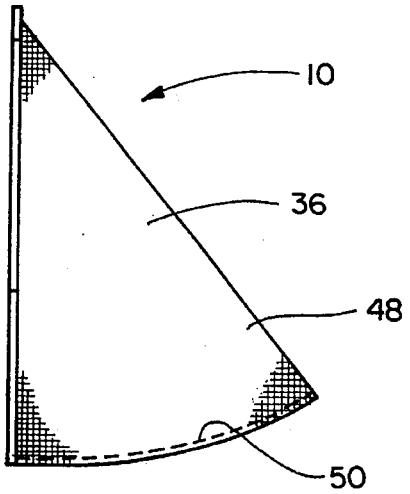
FIG. 7 is a elevation view of the present invention taken from line 5—5 of FIG. 4.

Referring to FIG. 6, the body portion 18 has been folded to illustrate the outward extension of the pouch section, best illustrated in FIG. 7, as well as the symmetry between the left section 54 and right section 56 of the body portion 18. It should be understood that in use the pouch section would be opened up and could be flexibly engaged about the wearer for suitable engagement of the wearer's elbow in the cavity 38. The pouch section includes a first outer surface and a second outer surface. The pouch section is positionable in a first position with the pouch section enveloping a right arm of the wearer with the first outer surface facing generally forwardly and the second outer surface facing generally rearwardly, the pouch section being swingable to a second position with the pouch section enveloping a left arm of the wearer with the first outer surface facing generally rearwardly and the second outer surface facing generally forwardly. Furthermore, while the pouch section is shown in the preferred embodiment as having a triangular type shape, it should be understood that it could also be of another shape, such as having crowed sides.

Although the invention has been described by reference to some embodiments it is not intended that the novel device be limited thereby, but that modifications thereof are intended to be included as falling within the broad scope and spirit of the foregoing disclosure, the following claims and the appended drawings.

I claim:

1. A breastfeeding garment for use by a woman while breastfeeding a child which conceals both the woman's breast and the child, the garment comprising:

(a) a body portion having a top section and a bottom section, the body portion extending downwardly over one of the woman's breasts;

(b) the body portion having a pouch section extending substantially from the top section to the bottom section, the pouch section being structurally sized for envelopment of either arm of a wearer, the pouch section having an inner cavity for receiving an elbow of the wearer, the pouch section being defined by first and second bounded edges being in converging relationship, the pouch section having a first outer surface and a surface, the pouch section being positionable in a first position with the pouch section enveloping a right arm of the wearer with the first outer surface facing generally forwardly and the second outer surface facing generally rearwardly, the pouch section being swingable to a second position with the pouch section enveloping a left arm of the wearer with the first outer surface facing generally rearwardly and the second outer surface facing generally forwardly;

(c) strap means connected to the top section of the body portion for extending around a neck of a wearer allowing the body portion to be swingable about the neck from the first position to the second position; and (d) a pair waist straps, with a waist strap extending from a respective left and right section of the body portion for extending around a waist of the wearer and in detachable engagement with one another.

2. The breastfeeding garment of claim 1, wherein the strap means includes a pair of neck straps extending from the top section of the body portion for extending around a neck of wearer and in detachable engagement with one another.

3. The breastfeeding garment of claim 1, wherein neck strap ends of the neck straps and waist strap ends of the waist straps include hook and loop type fastening members.

4. The breastfeeding garment of claim 1, wherein the body portion is formed of a single piece of material having right and left edges extending generally downwardly and outwardly from the top section to the bottom section over one of the woman's breasts.

5. The breastfeeding garment of claim 1, wherein a right section of the body portion extends substantially across and in confronting engagement with a left side of the wearer in the first position and a left section of the body portion extends substantially across and in confronting engagement with a right side of the wearer in the second position.

6. A breastfeeding garment for use by a woman while breastfeeding a child which conceals both the woman's breast and the child, the garment comprising:

(a) a body portion having a top section and a bottom section, the body portion extending downwardly over one of the woman's breasts;

(b) the body portion having a pouch section extending substantially from the top section to the bottom section, the pouch section having an inner cavity for receiving an elbow of the wearer, the pouch section being defined by first and second bounded edges being in converging relationship, the pouch section having a first outer surface and a second outer surface, the pouch section being positionable in a first position with the pouch section enveloping a right arm of the wearer with the first outer surface facing generally forwardly and the second outer surface faring generally rearwardly, the pouch section being swingable to a second position with the pouch section enveloping a left arm of the wearer with the first outer surface facing generally rearwardly and the second outer surface facing generally forwardly;

(c) strap means connected to the top section of the body portion for extending around a neck of a wearer allowing the body portion to be swingable about the neck from the first position to the second position.

7. The breastfeeding garment of claim 6, wherein the strap means includes a pair of neck straps extending from the top section of the body portion for extending around a neck of wearer and in detachable engagement with one another.

8. The breastfeeding garment of claims 6, further comprising a pair waist straps, with a waist strap extending from a respective left and right section of the body portion for extending around a waist of the wearer and in detachable engagement with one another.

9. The breastfeeding garment of claim 7, wherein neck strap ends of the neck straps include hook and loop type fastening members.

10. The breastfeeding garment of claim 8, wherein waist strap ends of the waist straps include hook and loop type fastening members.

11. The breast feeding garment of claim 8, wherein the body portion is formed of a single piece of material having right and left edges extending generally downwardly and outwardly from the top section to the bottom section over one of the woman's breasts.

12. A breastfeeding garment for use by a woman while breastfeeding a child which conceals both the woman's breast and the child, the garment comprising:

(a) a body portion having a top section and a bottom section, body portion being formed of a single piece of material having right and left edges extending generally downwardly and outwardly from the top section to the bottom section over one of the woman's breasts;

(b) the body portion having a pouch section extending substantially from the top section to the bottom section, the pouch section having an inner cavity for receiving an elbow of a wearer, the pouch section being selectively positionable on a left side or a right side of the wearer, the pouch section having a fold portion and stitched edge, the fold portion and stitched edge being in converging relationship to define the inner cavity with the fold portion extending diagonally from the top section;

(c) strap means connected to the top section of the body portion for extending around a neck of the wearer allowing the body portion to be swingable about the neck from a first position with the pouch section enveloping a right arm of the wearer to a second position with the pouch section enveloping a left arm of the wearer; and (d) a pair waist straps, with a waist strap extending from a respective left and right section of the body portion for extending around a waist of the wearer and in detachable engagement with one another.

13. The breastfeeding garment of claim 12, wherein the strap means includes a pair of neck straps extending from the top section of the body portion for extending around a neck of wearer and in detachable engagement with one another.

14. The breastfeeding garment of claim 13, wherein neck strap ends of the neck straps and waist strap ends of the waist straps include hook and loop type fastening members.

15. The breastfeeding garment of claim 12, wherein a right section of the body portion extends substantially across and in confronting engagement with a left side of the wearer in the first position and a left section of the body portion extends substantially across and in confronting engagement with a right side of the wearer in the second position.

* * * * *